US009787005B2

(12) United States Patent
Bluemmel et al.

(10) Patent No.: US 9,787,005 B2
(45) Date of Patent: Oct. 10, 2017

(54) CONTACT ELEMENT AND CONTACT ARRANGEMENT WITH FRONT PROTECTION AND METHOD OF PRODUCING THE LATTER

(71) Applicant: Tyco Electronics AMP GmbH, Bensheim (DE)

(72) Inventors: Uwe Bluemmel, Hemsbach (DE); Helge Schmidt, Speyer (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/643,723

(22) Filed: Mar. 10, 2015

(65) Prior Publication Data

US 2015/0255892 A1 Sep. 10, 2015

(30) Foreign Application Priority Data

Mar. 10, 2014 (DE) ..... 10 2014 204 358

(51) Int. Cl.
*H01R 4/62* (2006.01)
*H01R 4/18* (2006.01)
(Continued)

(52) U.S. Cl.
CPC ..... *H01R 4/62* (2013.01); *H01R 4/18* (2013.01); *H01R 4/185* (2013.01); *H01R 43/04* (2013.01);
(Continued)

(58) Field of Classification Search
CPC ..... H01R 4/185; H01R 4/188; H01R 4/625
(Continued)

(56) References Cited

U.S. PATENT DOCUMENTS 7,828,611 B2 11/2010 Nakamura et al.
2007/0178775 A1* 8/2007 Morello ..... H01R 4/185 439/877
(Continued)

FOREIGN PATENT DOCUMENTS

EP 2151893 A1 2/2010
GB 1494179 A * 12/1977 ..... H01R 4/188
(Continued)

OTHER PUBLICATIONS

European Search Report, Application No. 15157984.4, dated Jul. 13, 2015, 6 pages.

*Primary Examiner* — Tulsidas C Patel
*Assistant Examiner* — Marcus Harcum
(74) *Attorney, Agent, or Firm* — Barley Snyder

(57) ABSTRACT

The present invention relates to an electric contact element that has at least one crimping strap which is configured and arranged to reach around the outer circumference of an electric conductor, at least in sections, at least in a fully crimped state of the contact element. Furthermore, the invention relates to an electric contact arrangement that has at least one electric conductor and at least one contact element that has at least one crimping strap which is crimped, at least in sections, around an outer circumference of the conductor. Finally, the invention relates to a method of producing an electric contact arrangement, at least one crimping strap of a contact element being crimped, at least in sections, around an electric conductor. In order to seal an interior of the contact arrangement as simply and effectively as possible and with long-term stability against the penetration of corrosive media, provision is made according to the invention such that at least one front protection strap of the contact element is aligned running, at least in sections, transversely to the at least one crimping strap and rests
(Continued)

against the latter, a front section of the electric conductor being covered, at least in sections, by the at least one front protection strap.

12 Claims, 5 Drawing Sheets

(51) Int. Cl.
*H01R 43/048* (2006.01)
*H01R 43/04* (2006.01)
*H01R 4/70* (2006.01)

(52) U.S. Cl.
CPC ..... *H01R 43/0482* (2013.01); *H01R 4/70* (2013.01); *Y10T 29/49218* (2015.01)

(58) Field of Classification Search
USPC ..... 439/877, 878
See application file for complete search history.

(56) References Cited

U.S. PATENT DOCUMENTS

| | | | | |
|---|---|---|---|---|
| 2010/0035486 | A1* | 2/2010 | Tabata | H01R 4/185 439/877 |
| 2010/0122898 | A1 | 5/2010 | Yoshida | |
| 2013/0012077 | A1* | 1/2013 | Sato | H01R 4/188 439/877 |
| 2014/0273666 | A1* | 9/2014 | Corman | H01R 4/185 439/877 |
| 2015/0064991 | A1 | 3/2015 | Kawamura et al. | |
| 2015/0140873 | A1 | 5/2015 | Ito | |

FOREIGN PATENT DOCUMENTS

| | | | |
|---|---|---|---|
| WO | 2013142666 | A1 | 9/2013 |
| WO | 2014021338 | A1 | 2/2014 |
| WO | 2014024938 | A1 | 2/2014 |

* cited by examiner

CONTACT ELEMENT AND CONTACT ARRANGEMENT WITH FRONT PROTECTION AND METHOD OF PRODUCING THE LATTER

CROSS-REFERENCE TO RELATED APPLICATIONS

This application claims the benefit of the filing date under 35 U.S.C. §119(a)-(d) of German Patent Application No. 102014204357.1, filed Mar. 10, 2015.

FIELD OF THE INVENTION

The present invention relates to an electric contact element that has at least one crimping strap which is configured and arranged to reach around the outer circumference of an electric conductor, at least in sections, at least in a fully crimped state of the contact element.

Furthermore, the invention relates to an electric contact arrangement that has at least one electric conductor and at least one contact element that has at least one crimping strap which is crimped, at least in sections, around an outer circumference of the conductor. The invention also relates to a method of producing an electric contact arrangement, at least one crimping strap of a contact element being crimped, at least in sections, around an electric conductor.

BACKGROUND

In particular, when using aluminum cables as the electric conductor, it is desirable for the region in which the contact element is connected in an electrically conductive manner to the electric conductor to be protected against the penetration of humidity and other corrosive media because, in particular, aluminum in connection with chemically higher quality metals contained in the contact element can form a galvanic local element that is more prone to corrosion. Generally, corrosion between the contact element and the electric conductor can bring about worsening of the electrical and mechanical properties of a contact arrangement comprising the contact element and the conductor.

In order to prevent the penetration of humidity or other corrosive media it is known to enclose the electric conductor on the outer circumference as completely as possible with the at least one crimp barrel and to seal the connection region of the contact element and the conductor in the direction of its insulation with the aid of a section of the insulation encompassed by the at least one conductor strap. A front section of the conductor can be sealed, for example, with the aid of a section of the insulation that is separated from the insulation by stripping the electric conductor and which, upon crimping the contact element, is also deformed such that it seals the contact arrangement on the front side.

This type of contact arrangement is known, for example, from the International Patent Application given publication number WO 2013/142666 submitted by the Applicant, the content of which is fully incorporated herein. It is also known to seal the connection region between the electric conductor and the contact element with, for example, sealing additives, such as, for example, greases, which prevent, in particular, capillary effects. Furthermore, publication EP 2 151 893 A1 discloses an electric contact arrangement in which a free end of an electric conductor crimped in a barrel can be covered obliquely with a limitation section moulded onto crimping straps or a base of the barrel. On the one hand, the free end should thus be held down, and, on the other hand, it should be protected against contact with an electrolyte, such as water.

It is desirable to have the front section of such contact arrangements sufficiently sealed or protected against damaging mechanical effects that may have a negative impact upon the seal of the front section during use of the contact arrangement. On the other hand, the seal may be intricate and prone to fault due to separated sections of the insulation and/or inflammable materials. Crimp barrels shown in the prior art, in particular those known from EP 2 151 838 A1, also have openings and slots via which corrosive media can penetrate into the font section or interior of the contact arrangement.

SUMMARY

It is the object of the invention among other objects, to provide a contact arrangement that is as simple and as inexpensive to produce as is possible, but at the same time is sealed as well as possible and is stable in the long-term.

According to the invention, an electric contact element, adapted for assembly with an electrical conductor, comprises a crimping strap configured and arranged to reach around at least partially the outside of the electrical conductor extending substantially transversely to the crimping strap when in a fully crimped state of the contact element and a protection strap extending substantially transversely to the crimping strap configured and arranged to cover and rest against at least partially the crimping strap and cover a section of the conductor when the crimping strap is in a fully crimped state.

An advantage of the present invention is that by using the protection strap one can dispense with rolling of the material of the contact element to provide sealing of the electric conductor. The sealing can be achieved by the protection strap. In other words, the contact element can have a protection strap for at last partially covering the electric conductor or the connection region between the electric conductor and the contact element substantially transversely to a longitudinal direction of the contact element or the contact arrangement. The protection strap can end flush with the front edge or face side. Thus, all of the openings on the front side of the contact element can be fully closed.

The front protection strap can be deformed separately from the crimping strap which, therefore, no longer need serve to seal the front region, but can be configured and arranged purely to at least partially encompass the electric conductor along the longitudinal direction. The protection strap can rest flat against a conductor receptacle formed by the contact element or an internal space for the electric conductor or delimit the latter on the face side. The protection strap can be disposed substantially between the crimping strap and the contact section of the contact element for contact with a counter-contact element or similar.

The solutions according to the invention can be combined in various ways and be further improved with the following additional embodiments, each one advantageous in its own right.

According to a first additional advantageous embodiment, the protection strap can be bent substantially at a right angle in the fully crimped state. In other words, the front protection strap can be simply crimped or turned down. A flat side of the front protection strap can thus finish the conductor receptacle, at least in sections. For example, in the region of a front end of a crimping section of the contact element, the front protection strap can be attached as a flat strap which is bent in a transition region between the crimping section and the contact section, for example, with a covering section, at least in the fully crimped state, and so covers an end of the contact element or the contact arrangement on the contact side. Even before reaching the fully crimped state, the front protection strap can be folded, for example, in a pre-crimped state of the contact element, so that the interior of the contact element or the contact arrangement can be covered, at least partially, in a front region.

The front protection strap can be configured and arranged to rest against a base of the contact element in the fully crimped state. For example, the front protection strap can rest against the base, and at the same time against a front edge or face side of the crimping strap. Thus, the front protection strap, interacting with the base and the crimping strap, can seal the conductor receptacle.

The front protection strap can be formed integrally with the crimping strap and extend away from the latter. Alternatively or additionally, the front protection strap can be formed on a base of the contact element and extend away from the latter. Thus, the front protection strap can simply be formed integrally with the material forming the other sections of the contact element. The contact element can be punched, for example, from sheet material. A plurality of contact elements can be formed in one punching strip.

The contact element can have at least one additional front protection strap that is configured and arranged to cover, at least partially, the front section running substantially transversely to the crimping strip, in the fully crimped state. For example, the front protection strap and the additional front protection strap can respectively be formed on a crimping strap forming a beam of the contact element.

The front protection strap and the additional front protection strap can be arranged lying substantially opposite one another in relation to a center axis of the crimp contact element. Thus, the two front protection straps can respectively cover, for example, at least half of the front section or of a front end of the conductor receptacle or the interior.

The front protection strap and the additional front protection strap can overlap in a longitudinal direction of the contact element, in the fully crimped state. In other words, the front protection strap and the additional front protection strap can be arranged lying over one another in a projection along the longitudinal direction. For this purpose the front protection strap and the additional front protection strap can be arranged along the longitudinal direction, offset from one another. By means of the overlap and the offset arrangement, the front section of the electric conductor and the front side of the conductor receptacle or of the interior can be sealed in a particularly effective and stable manner.

A free end of the front protection strap can be provided with a chamfer. The chamfer can be inclined in the opposite direction to the longitudinal direction. The front protection strap and the additional front protection strap can be chamfered in substantially opposite directions so that they overlap in the region of the chamfers in the longitudinal direction and are pressed together and can be engaged with one another. Thus, the front protection strap and/or the additional front protection strap can rest as flat as possible against one another or against a section lying opposite in order to seal as effectively as possible the front section of the conductor or the conductor receptacle.

In the following, the invention will be described in more detail using, as examples, possible embodiments with reference to the attached drawings. The feature combinations shown by these embodiments serve purely as illustrations. Individual features may also be omitted according to their advantages as described above if the advantage of the respective feature is of no consequence to a specific application.

In the description of the embodiments, for the sake of simplicity the same features and elements are provided with the same reference signs. Features and elements with the same or at least similar functionality generally have the same reference number or the same reference letters which is or are provided with one or a number of apostrophes in order to identify an additional embodiment or possible configuration.

DETAILED DESCRIPTION OF THE EMBODIMENT(S)

Figure 1:
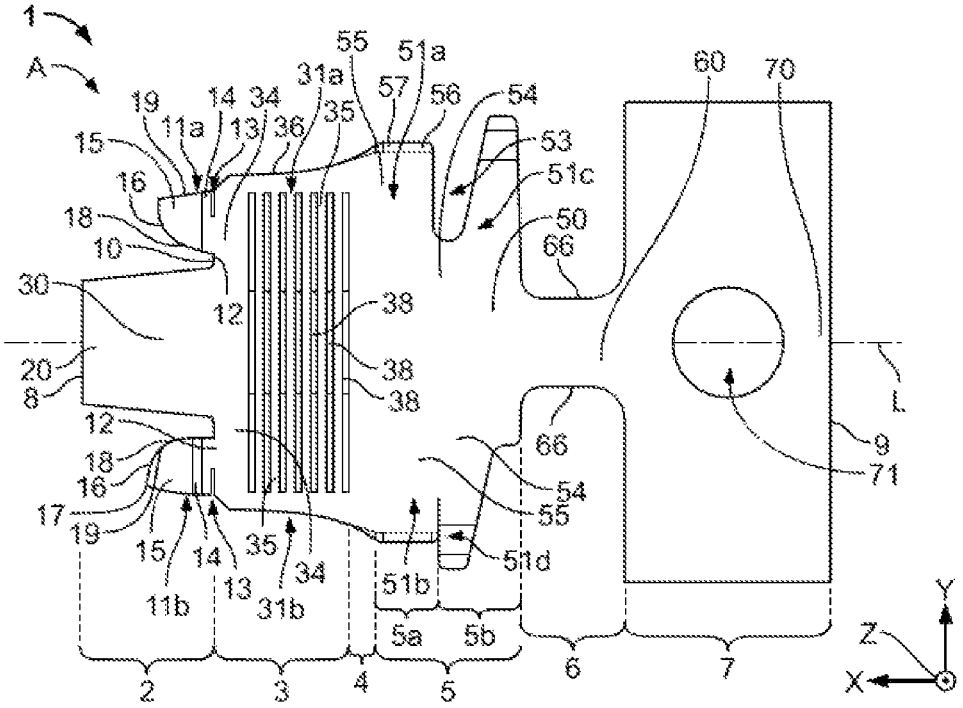
FIG. 1 a top view of a first embodiment of a contact element according to the invention in an uncrimped state.

A first embodiment of a contact element 1 according to the invention is described with reference to FIGS. 1, 2 and 3. This embodiment shows the contact element 1 in an uncrimped state A. In the uncrimped state A, the contact element 1 can be fully planar, as it is, for example, directly after being punched from a sheet material, and can extend substantially in a longitudinal direction X and a transverse direction Y without parts of the contact element protruding in a height direction Z. For example, a sheet thickness can be measured substantially parallel to the height direction Z. The longitudinal direction X, the transverse direction Y and the height direction Z together form a Cartesian coordinate system.

The contact element 1 has a contact section 2, a conductor section 3, a transition section 4, an insulation section 5, a connection section 6 and a handling section 7 that are strung together between a front end 8 and a rear end 9 of the contact element 1 in the direction opposite to the longitudinal direction X. Formed on a face side 10 of the contact element 1, disposed between the contact section 2 and the conductor section 3 and facing in the longitudinal direction X, are a front protection strap 11*a* and an additional front protection strap 11*b* which are arranged opposite one another in relation to a longitudinal axis L of the contact element 1 running parallel to the longitudinal direction X and these form front protection 11 for the contact element 1 in a fully crimped state C of the contact element 1 (see FIG. 4).

Each of the two front protection straps 11*a*, 11*b* is connected to the face side 10 by a stem 12. In the region of the stem 12, the two front protection straps 11*a*, 11*b* are slotted or a slot 13 is formed between the front protection strap 11*a*, 11*b* and the face side 10. Adjoining the stem 12 in the longitudinal direction X is a bending section 14 that connects the stem 12 to a covering section 15 of the front protection strap 11*a*, 11*b* following the bending section 14 in the longitudinal direction X. The covering section 15 forms a free end 16 of the front protection strap 11*a*, 11*b*. On the free end 16, the front protection straps 11*a*, 11*b* are provided with a chamfer 17. In the direction towards the longitudinal axis L, each front protection strap 11*a*, 11*b* has a rounding 18 between the free end 16 and the bending section 14. A side edge 19 of the front protection strap 11, extending between the free end 16 and the bending section, 14 runs substantially in a straight line.

Figure 7:
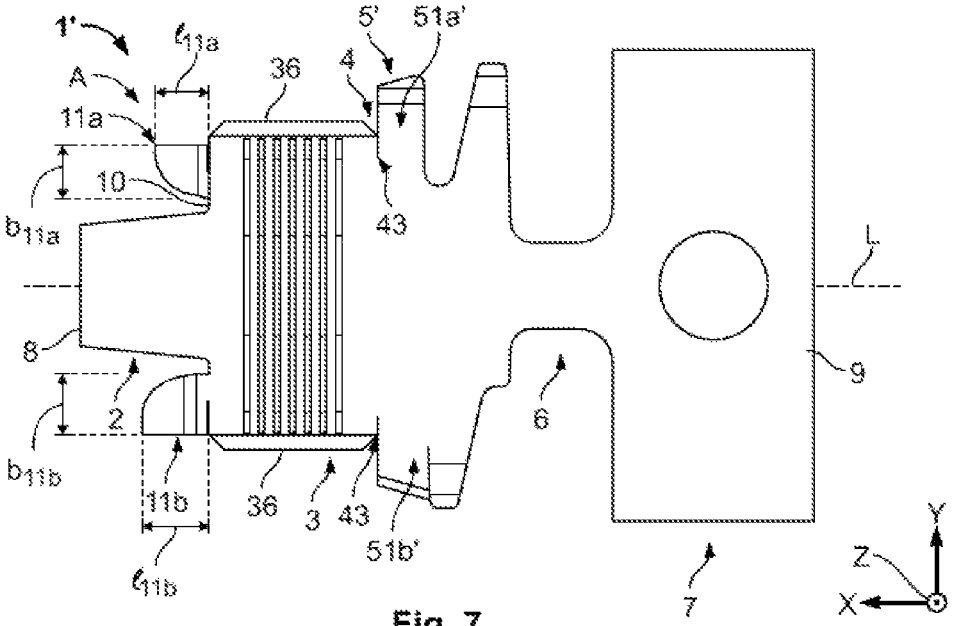
FIG. 7 a top view of an additional embodiment of a contact element according to the invention in the uncrimped state.

Furthermore, it can be seen in FIGS. 1 and 7 that a length $I_{11b}$ of the additional front protection strap 11*b*, measured substantially parallel to the longitudinal axis L, exceeds a length $I_{11a}$ of the front protection strap 11*a* likewise measured substantially parallel to the longitudinal axis L. In particular, the front protection strap 11*b* has a stem 12 that is longer than the front protection strap 11*a* measured substantially parallel to the longitudinal axis L. A width $b_{11a}$ of the front protection strap 11*a* measured substantially parallel to the transverse direction Y corresponds largely to a width $b_{11b}$ of the front protection strap 11*b* likewise measured substantially parallel to the transverse direction Y. As shown in FIGS. 1 and 2, the contact section 2 can have reinforcement elements 20 which can be, for example, in the form of beads or similar, in order to increase the flexural rigidity of the contact section 2. On the front end 8, the contact section 2 can be provided with a contact component (not shown) formed according to the respective requirements. The contact component can be, for example, a terminal box or a socket contact, a pin contact, a fastening eye or the like.

Figure 4:
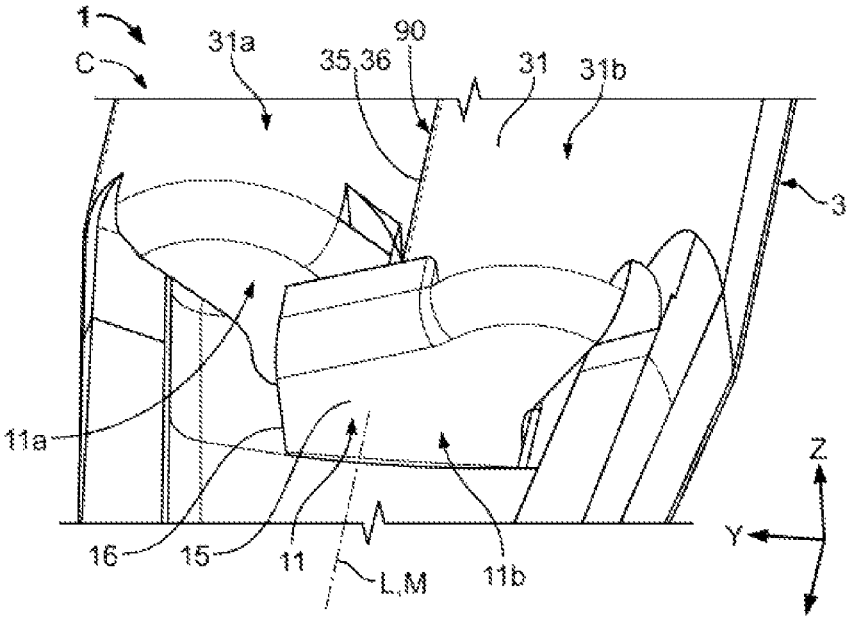
FIG. 4 a detailed view of a contact arrangement according to the invention with the contact element shown in FIGS. 1 to 3 in a fully crimped state.
Figure 6:
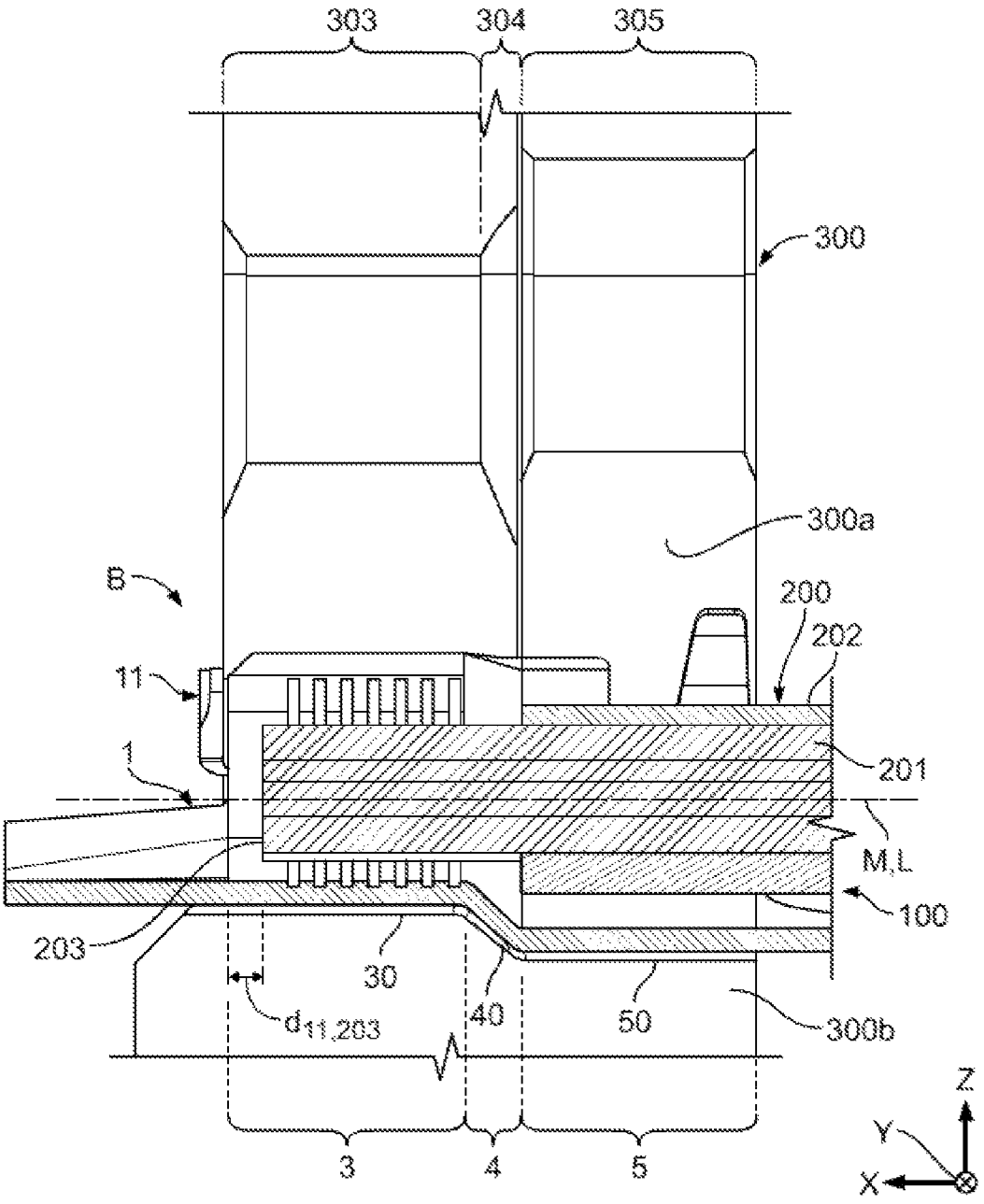
FIG. 6 a cross-sectional view of a contact element according to the invention that is positioned together with an electric conductor in a crimping tool to produce a contact arrangement according to the invention.

The conductor section 3 comprises a base 30. On either side of the base 30, lying opposite with regard to the longitudinal axis L, a crimping strap 31*a* and an additional crimping strap 31*b* are formed on the contact element 1. As shown in FIG. 4, in the fully crimped state C, the crimping straps 31*a*, 31*b* form a cover 31 for the contact element 1. The crimping straps 31*a*, 31*b* are respectively connected to the base 30 by a bending region 34. Flanks 35 of the crimping straps 31*a*, 31*b* form outer edges 36 of the crimping straps 31*a*, 31*b* pointing away from the longitudinal axis L substantially in the transverse direction Y or in the opposite direction. The conductor section 3 is provided with groove-shaped indentations 38 extending substantially parallel to the transverse direction Y over the entire base 30 and into the beams 35 and which improve a connection between the contact element 1 and an electric conductor as seen in FIG. 6.

Furthermore, the conductor section 3 passes via the transition section 4 into a sealing section 5*a* of the insulation section 5 adjoining which is a holding section 5*b* of the insulation section 5 in the direction opposite the longitudinal direction X. In the sealing section 5*a*, a sealing strap 51*a* and an additional sealing strap 51*b* extend away from the longitudinal axis L from a base 50 of the contact element 1 in the region of the insulation section 5 in the transverse direction Y and in the opposite direction. Similarly to the crimping straps 31*a*, 31*b*, the sealing straps 51*a*, 51*b* are respectively connected, via a bending region 54, to the base 50 of the insulation section 5 and have beams 55 which form outer edges 56. Similarly to the sealing straps 51*a*, 51*b*, holding straps 51*c*, 51*d*, formed in the holding section 5*b*, likewise extend away from the longitudinal axis L in the transverse direction Y and in the opposite direction and are connected to the base 50 via the bending region 54. The holding straps 51*c*, 51*d* are respectively displaced from the sealing straps 51*a*, 51*b* by a slot 52. The connection section 6 likewise has a base 60 and outer edges 66. Formed in a base 70 of the handling section 7 is a handling component 71 in the form of an eye or a through hole which facilitates handling and precise positioning of the contact element 1, in particular when processing the latter.

Figure 2:
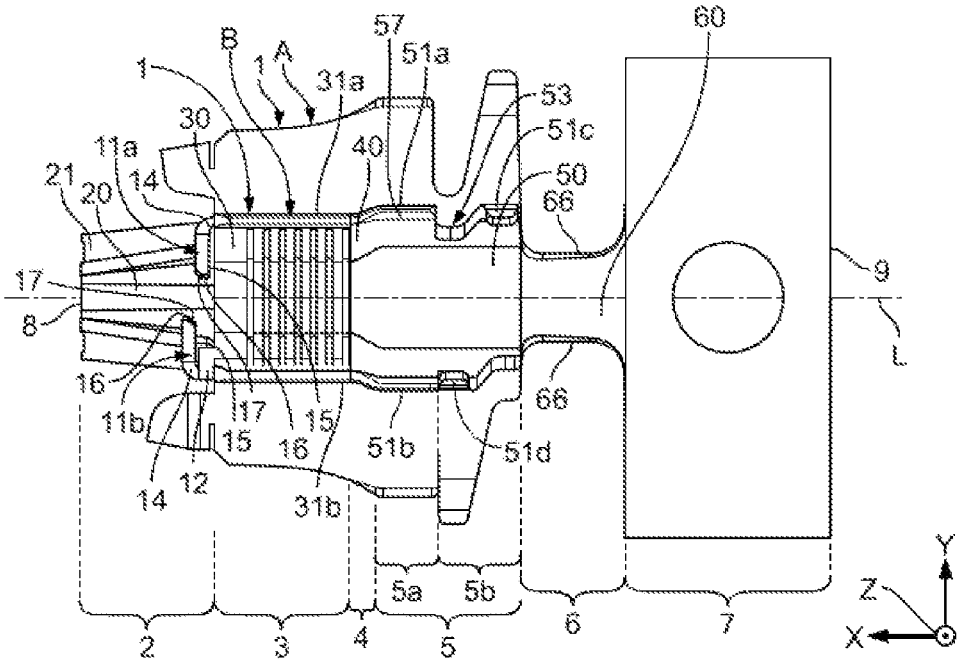
FIG. 2 a top view of the contact element shown in FIG. 1 in a pre-crimped state.

FIG. 2 shows the contact element in a top view in a pre-crimped state B in comparison to the silhouette of the contact element 1 in the uncrimped state A. In the pre-crimped state B, the contact section 2 or the base 20 in the region of the contact section 2 is provided with the reinforcement element 21. The crimping straps 31*a*, 31*b* are bent round in the direction away from the base 30 in their respective bending region 34 and so point with their outer edges substantially in the height direction Z. The front protection straps 11*a* and 11*b*, disposed on the face sides 10 of the crimping straps 31*a*, 31*b*, are bent around substantially at right angles on their bending sections 14 so that the free ends 16 of the front protection straps 11*a*, 11*b* point in the direction towards the longitudinal axis L. The chamfer 17 on the front protection strap 11*a* points substantially in the opposite direction to the transverse direction Y and in the longitudinal direction X towards the chamfer 17 aligned in the opposite direction on the front protection strap 11*b*. The covering sections 15 of the front protection straps 11*a*, 11*b* are disposed at different heights in relation to one another along the longitudinal direction X so that the covering section 15 along the transverse direction Y is substantially aligned with an empty space between the covering section 15 of the crimping strap 11*b* and the face side 10 in the region of the base 30 and/or the crimping strap 31*b*.

Furthermore, in the transition section 4, the insulation section 5 and the connection section 6, the respective beams and sealing straps 51*a*, 51*b*, holding straps 51*c*, 51*d* and at least outer edges 66 are also bent round at respective bending regions 44, 54, 64 and so point at least proportionately in the height direction Z. The chamfers 57 formed on the sealing straps 51*a* and which taper in the longitudinal direction X in the transition section 4 point at least proportionately towards one another in the transverse direction Y. The additional holding strap 51*d* is disposed lying opposite the slot 52 on the longitudinal axis L in the transverse direction Y.

Figure 3:
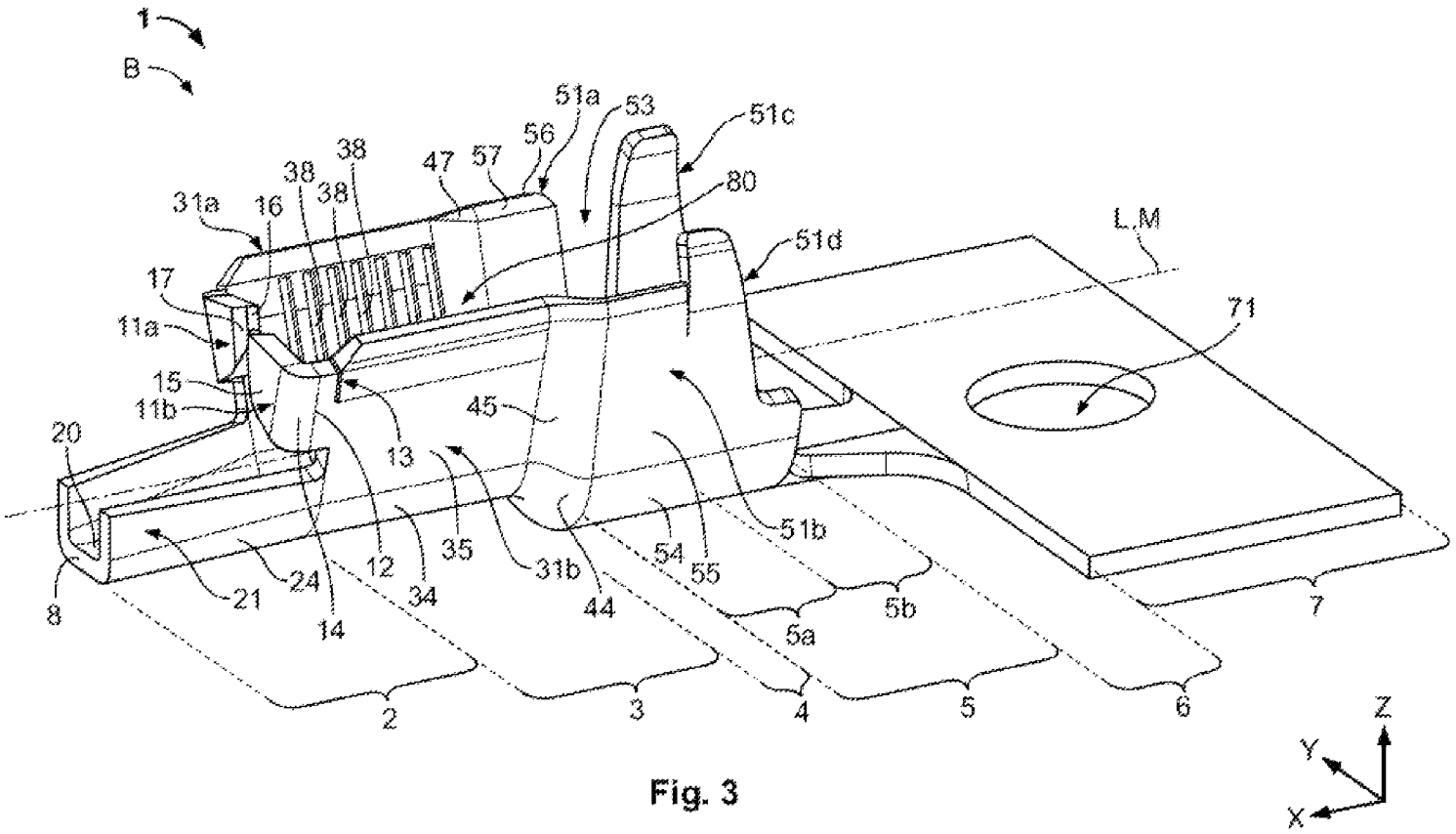
FIG. 3 a perspective view of the contact element shown in FIGS. 1 and 2 in the pre-crimped state.

FIG. 3 shows the contact element 1 in the pre-crimped state B in a perspective view. It becomes clear here that the reinforcement structure 21 formed like a beam, the crimping straps 31*a*, 31*b*, the beams 45 in the transition section 4, the sealing straps 51*a*, 51*b* and the holding straps 51*c*, 51*d* are bent away in their respective bending regions 24, 34, 44 and 54 from the respective bases 20, 30, 40 and 50 in the height direction Z and at least in sections delimit an interior 80 of the contact element 1 in the transverse direction Y and in the opposite direction. Furthermore, the interior 80 is delimited by the bases 20, 30, 40, 50, in particular the bases 30, 40 and 50 in the conductor section 3, the transition section 4 and the insulation section 5 in the opposite direction to the height direction Z. In the longitudinal direction X, the interior 80 is delimited at least in sections by the front protection straps 11*a*, 11*b*, in particular by their covering sections 15. A center axis M of the contact element 1 runs substantially parallel to the longitudinal axis L above the bases 20, 30, 40, 50 centrally between the beams 35, 45, 55 though the interior 80.

FIG. 4 shows a detail of the contact element 1, in particular its front protection 11 in the fully crimped state C in a perspective view. It becomes clear here that in the fully crimped state C the crimping straps 31*a*, 31*b* are bent round and/or rolled to such an extent that they form a seam 90 along the beams 35 that strike one another and/or the outer edges 36 which can run substantially along the center axis M. The crimping straps 31*a*, 31*b* thus form the closed cover 31 of the contact element 1 which, at least in sections, delimit the interior 80, shown in FIG. 3, in the opposite direction to the height direction Z. The roundings 18, respectively, nestle up against the crimping straps 31*a*, 31*b* on the inside around the circumference.

In the longitudinal direction X, the interior 80 is delimited or closed, at least in sections, by the front protection 11 formed by the front protection straps 11*a*, 11*b*. In the region of their covering sections 15, the front protection straps 11*a*, 11*b* can overlap, at least in a projection along the center axis M. In other words, for example, the free end 16 of the front protection strap 11 can project over the center axis M. Thus, the additional front protection strap 11*b* can be disposed behind the front protection strap 11*a* in the longitudinal direction X, resting against the latter. The front protection strap 11*a* can project into the space formed between the covering section 15 of the front protection strap 11*b* and the face side 10 or be accommodated with form locking and/or force fit in said space, and this can help to improve the stability of the front protection 11.

Figure 5:
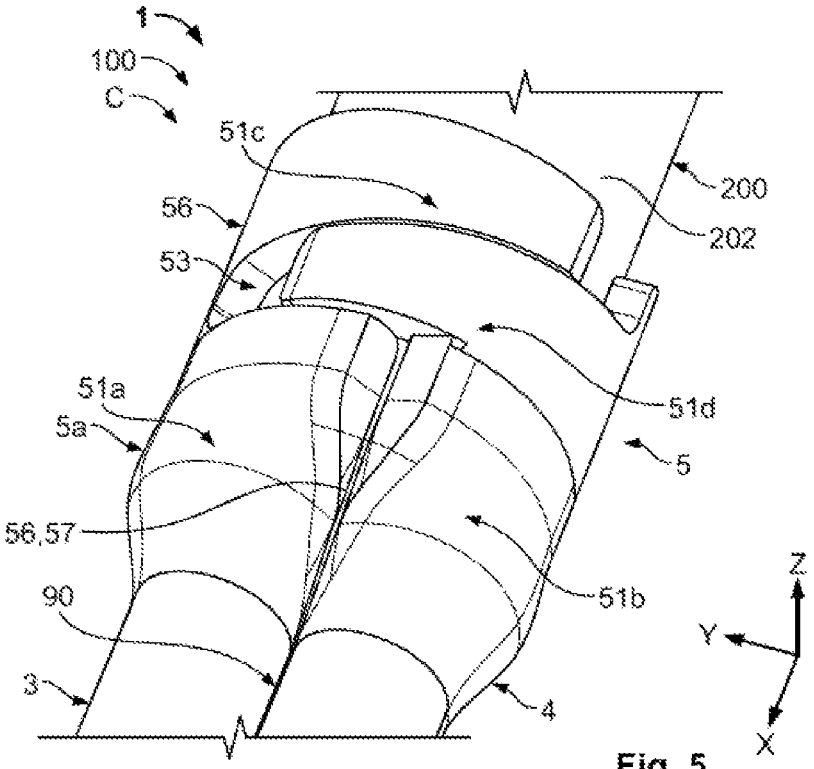
FIG. 5 a perspective view of a detail of the contact arrangement shown in FIG. 4.

FIG. 5 shows another part of the contact element 1 and a contact arrangement 100 configured according to the invention and comprising the latter in the fully crimped state C, in particular in the transition section 4 and the insulation section 5. It becomes clear here that the outer edges 56 and, in particular, the chamfers 57 of the sealing straps 51*a*, 5*ab* can rest flush against one another in the fully crimped state C and so the seam 90 can extend without interruption over the transition section 4 into the sealing section 5. The holding straps 51*c*, 51*d* enclose an electric conductor 200, the electric cable 201 of which is crimped in the interior 80, shown in FIG. 3, and on the outer circumference on its insulation 202. The additional holding strap 51*d* is embedded at least in sections in the slot 52 and can be held within the latter with form locking and/or force fit.

FIG. 6 shows the contact element 1 and the contact arrangement 100 in the pre-crimped state B in a cross-sectional view along the center axis M in a plane in a crimping tool 300 stretching substantially parallel to the longitudinal direction X and height direction Z. The crimping tool 300 can be, for example, a crimping die that can have a stamp 300*a* and an anvil 300*b*. The contact element 1 is placed, at least with the bases 30, 40, 50, onto the anvil 300*b* so that at least the conductor section 3, the transition section 4 and the insulation section 5 are disposed in a corresponding conductor mould 303, a transition mould 304 or an insulation mould 305 of the crimping tool 300. The electric conductor 200 is stripped in a region disposed at least in the conductor section 3. A front section 203 of the electric conductor 200 or its electric cable 201 is disposed a distance $d_{11,\,203}$ away from the front protection 11, measured substantially parallel to the longitudinal direction X, so that the crimp indentor 300*a* can move down towards the anvil 300*b* in order to transfer the contact arrangement 100 from the pre-crimped state B into the fully crimped state C and can thus crimp the insulation section 5, the connection section 6 and the handling section 7 without having any negative impact upon the front protection 11.

FIG. 7 shows another embodiment of a contact element 1' according to the invention in the uncrimped state A. Unlike the contact element 1, sealing straps 51*a*', 51*b*' are formed on the contact element 1' such that they project over the outer edges 36 of the holding section 13 or in the opposite direction to transverse direction Y similarly to the holding straps 51*c*, 51*d*. In order to nevertheless be able to provide reliable crimping and thus sealing enclosure of the interior 80, an additional slot 43 is respectively provided between the beams 45 of the transition section 4 and the sealing straps 51, 51*b*.

Figure 8:
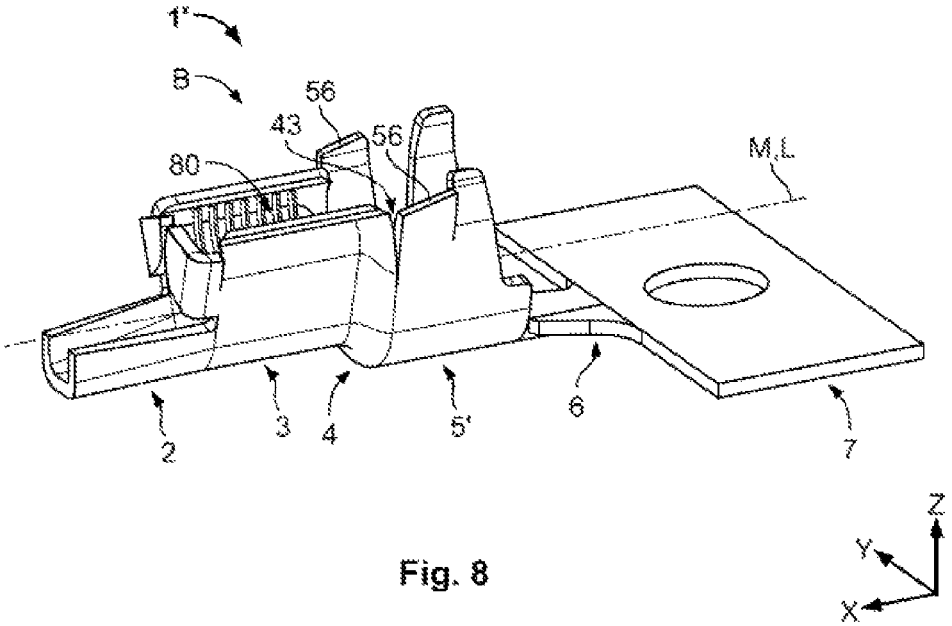
FIG. 8 a perspective view of the contact element shown in FIG. 7 in the pre-crimped state.

FIG. 8 shows the contact element 1' in the pre-crimped state B. It becomes clear here that at least outer edges 56 of the sealing straps 51*a*', 51*b*' are displaced from the transition section 4 by the respective slot 43. This makes it possible to crimp transition sections 4 and insulation sections 5 without these having any negative impact upon one another.

Within the framework of the thinking behind the invention, deviations from the embodiments described above are possible. Thus, a contact element 1, 1' according to the invention can be provided, according to the respective requirements, with contact sections 2, conductor sections 3, transition sections 4, insulation sections 5, 5', handling sections 7, front ends 8 and rear ends 9, which according to the respective requirements, can have any number and form of face sides 10, front slots 11, front straps 11*a*, 11*b*, stems 12, slots 13, bending sections 14, covering sections 15, free ends 16, chamfers 17, roundings 18, side edges 19, bases 20, reinforcement elements 21, bases 30, covers 31, crimping straps 31*a*, 31*b*, bending regions 34, beams 35, outer edges 36, chamfers 37, indentations 38, bases 40, slots 43, bends 44, beams 45, bases 50, sealing straps 51*a*, 51*b*, holding straps 51*c*, 51*d*, bending regions 54, beams 55, outer edges 56, chamfers 57, bases 60, outer edges 66, bases 70, handling components 71, so as to enclose an interior 80 such that it is sealed as well as possible and is as stable as possible with the formation, for example, of a seam 90, which interior can be configured according to the respective requirement in order to accommodate at least one electric conductor 200 within it and to form with the latter a contact arrangement 100 configured according to the respective requirements. Accordingly, a crimping tool 300 according to the invention can be configured, according to the respective requirements, to crimp the contact element 1, 1' with the electric conductor or conductors 200.

What is claimed:

1. An electric contact element adapted for assembly with an electrical conductor, said electric contact element comprising:

a first crimping strap and a second crimping strap each configured and arranged to reach around at least partially the outside of the electric conductor extending substantially transverse to the crimping straps when in a fully crimped state of the contact element; and a first protection strap and a second protection strap each extending substantially transverse to the crimping straps and configured and arranged to cover and rest against at least partially the crimping straps and cover an end of the conductor when the crimping straps are in a fully crimped state of the contact element, the first protection strap and the second protection strap overlapping in a longitudinal direction of the contact element in the fully crimped state.

2. The electric contact element according to claim 1, wherein the protection straps are configured and arranged to rest against the contact element in the fully crimped state.

3. The electric contact element according to claim 2, wherein the first protection strap is formed integrally with the first crimping strap and extends away from the first crimping strap.

4. The electrical contact element according to claim 1, wherein the two protection straps are disposed substantially opposite one another in related to a center axis of the contact element.

5. The electric contact element according to claim 1, wherein a free end of each of the protection straps has a chamfer.

6. An electric contact assembly comprising:

an electric conductor; and an electrical contact element having:

a first crimping strap and a second crimping strap each reaching around at least partially the outside of the electric conductor extending substantially transverse to the crimping straps when in a fully crimped state of the contact element; and a first protection strap and a second protection strap extending substantially transverse to the crimping straps and covering and resting against at least partially the crimping straps and covering an end of the electric conductor when the crimping straps are in a fully crimped state of the contact element, the first protection strap and the second protection strap overlapping in a longitudinal direction of the contact element in the fully crimped state.

7. The electric contact assembly according to claim 6, wherein the protection straps are individually formed integrally with the crimping straps and extend away from the respective crimping straps.

8. The electric contact assembly according to claim 6, wherein the two protection straps are disposed substantially opposite one another in relation to a center axis of the contact element.

9. The electric contact assembly according to claim 6, wherein a free end of each of the protection straps has a chamfer.

10. The electric contact element according to claim 1, wherein the protection strap is bent substantially at a right angle in the fully crimped state.

11. The electric contact assembly according to claim 6, wherein the protection strap is bent substantially at a right angle in the fully crimped state.

12. A method of producing an electric contact assembly, comprising:

crimping a first crimping strap and a second crimping strap around at least partially the outside of an electric conductor extending substantially transverse to the crimping straps; and covering an end of the electric conductor when the crimping straps are in a fully crimped state with a first protection strap and a second protection strap, the first protection strap and the second protection strap extending substantially transverse to the crimping straps, covering and resting against at least a part of the crimping straps, and overlapping in a longitudinal direction of the electric conductor in the fully crimped state.

* * * * *